US005536440A

United States Patent [19]

Gopalkrishnan et al.

[11] Patent Number: 5,536,440

[45] Date of Patent: * Jul. 16, 1996

[54] STABLE, AQUEOUS CONCENTRATED LIQUID DETERGENT COMPOSITIONS CONTAINING HYDROPHILIC COPOLYMERS

[75] Inventors: Sridhar Gopalkrishnan, Woodhaven; John V. Sherman, Allen Park; Kathleen M. Guiney, Wyandotte; David T. Durocher, Westland; Michael C. Welch, Woodhaven, all of Mich.

[73] Assignee: BASF Corporation, Mount Olive, N.J.

[ * ] Notice: The term of this patent shall not extend beyond the expiration date of Pat. No. 5,534,183.

[21] Appl. No.: 274,948

[22] Filed: Jul. 14, 1994

[51] Int. Cl.[6] ..... C11D 3/37; C11D 3/28; C11D 11/00; C11D 17/00

[52] U.S. Cl. ..... 510/417; 510/418; 510/434; 510/476; 510/337; 510/340; 510/321; 510/393; 510/424

[58] Field of Search ..... 252/173, 174.21, 252/174.23, 174.24, DIG. 2, 524, 542, 174, DIG. 14

[56] References Cited

U.S. PATENT DOCUMENTS

| | | | |
|---|---|---|---|
| 4,421,902 | 12/1983 | Chang et al. | 252/174.24 |
| 4,429,097 | 1/1984 | Chang et al. | 252/174.24 |
| 4,622,378 | 11/1986 | Gosselink | 528/66 |
| 4,664,848 | 5/1987 | Oh et al. | 252/DIG. 2 |
| 4,676,921 | 6/1987 | Vander Meer | 252/174.23 |
| 4,685,931 | 8/1987 | Schieferstein et al. | 252/174.24 |
| 4,992,194 | 2/1991 | Liberati et al. | 252/DIG. 2 |
| 5,009,865 | 4/1991 | Pernev et al. | 252/174.23 |
| 5,047,167 | 9/1991 | Steyn et al. | 252/174.24 |
| 5,066,749 | 11/1991 | Leighton et al. | 252/174.24 |
| 5,073,285 | 12/1991 | Libereti et al. | 252/174.23 |
| 5,108,644 | 4/1992 | Machin et al. | 252/174.23 |
| 5,126,069 | 6/1992 | Kud et al. | 252/174.23 |
| 5,147,576 | 9/1992 | Montague et al. | 252/174 |
| 5,162,475 | 11/1992 | Tang | 528/333 |

FOREIGN PATENT DOCUMENTS 58-5398 1/1983 Japan .

OTHER PUBLICATIONS van de Pas et al. *Colloidal effects of anchored polymers in lamellar liquid–crystalline dispersions. Colloids & Surfaces A: Physiochemical and Engineering Aspects,* vol. 85 (1994), pp. 221–236.

U.S. Ser. No. 08/274,938 filed Jul. 14, 1994 Gopalkrishnan et al.

*Primary Examiner*—Paul Lieberman
*Assistant Examiner*—A. Hertzog
*Attorney, Agent, or Firm*—Joanne P. Will

[57] ABSTRACT

A hydrophilic co-polymer, useful in stabilizing laundry detergent, comprising two hydrophilic monomers: an unsaturated hydrophilic monomer co-polymerized with a hydrophilic oxyalkylated monomer.

15 Claims, No Drawings

STABLE, AQUEOUS CONCENTRATED LIQUID DETERGENT COMPOSITIONS CONTAINING HYDROPHILIC COPOLYMERS

FIELD OF THE INVENTION

The present invention relates to hydrophilic copolymers, and more particularly, to stable, aqueous-based, concentrated liquid detergents that contain the hydrophilic copolymers and thus permit the incorporation of builders, polymers and other water-insoluble components to form a stable composition. The invention also relates to a method of stabilizing liquid detergent compositions.

BACKGROUND OF THE INVENTION

The incorporation of major amounts of builders in liquid detergent compositions poses a significant formulating challenge since the presence of major amounts of builder inevitably causes the detergent composition to phase separate. Builders such as sodium citrate, citric acid, sodium carbonate, and/or alkali metal silicates can only be incorporated in minor amounts in liquid detergent compositions, such amounts being typically below the concentration levels that would cause separation of the surfactant phase. Liquid detergent formulations that contain builders thus require careful control of the surfactant to builder ratio so as to prevent "salting-out" of the surfactant phase. The literature is replete with examples of such compositions.

Montague, U.S. Pat. No. 5,147,576, relates to detergent compositions that comprise a relatively high amount of detergent active matter and further allow the incorporation of builders and suspension of particulate solids. Such compositions are prepared by adding an electrolyte/builder to the surfactant rich aqueous phase so as to result in a structure of lamellar droplets dispersed in the continuous aqueous phase. These compositions also require the incorporation of a minor amount of a "deflocculating polymer" in the detergent composition. The deflocculating polymer, according to this reference, is required to comprise of a hydrophilic backbone with at least one hydrophobic side chain. The preparation of such polymers are accomplished by copolymerizing hydrophilic monomers with a hydrophobic monomer. The hydrophobic monomer contains a hydrophobic side chain. The polymerization of the hydrophilic monomer and the hydrophobic monomer is conducted in a cosolvent, which is typically water and another solvent in which the hydrophobic monomer is soluble.

OBJECTS OF THE INVENTION

It is therefore an object of the present invention to incorporate a hydrophilic copolymer into a liquid detergent composition which will impart stability to the detergent over extended periods of storage.

Another object of the present invention is to provide an aqueous-based laundry detergent formulation which has significant amounts of detergent active matter and builders which shows virtually no phase separation.

A further object of the invention is to provide a novel, hydrophilic copolymer useful in stabilizing liquid laundry detergents.

Another object is to provide a method of stabilizing laundry formulations.

SUMMARY OF THE INVENTION

These and other objects of the invention are achieved by providing a stable liquid detergent composition which contains about 5–70% of detergent active matter selected from the group consisting of anionic, nonionic, cationic, amphoteric and zwitterionic surfactants, as well as about 1–60% of one or more electrolytes. The detergent composition also has about 0.01–5% of at least one hydrophilic copolymer represented by formula I or II:

Formula I

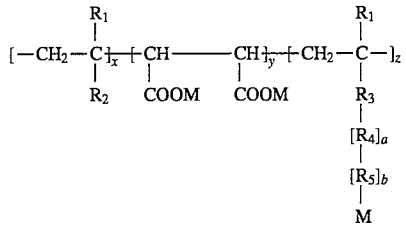

Where x, y, z, a, and b are integers and M is a alkali metal such as sodium, or hydrogen and the monomer units are in random order. (x+y):z is from about 5:1 to 1000:1, and y can be any value ranging from zero up to the maximum value of x, and $R_1$=H or $CH_3$ $R_2$=COOM, $OCH_3$, $SO_3M$, O—CO—$CH_3$, CO—$NH_2$ $R_3$=$CH_2$—O—, $CH_2$—N—, COO—, —O—,

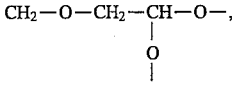

CO—NH—

$R_4$=—$CH_2$—$CH_2$—O $R_5$=alkyleneoxy group, preferably propyleneoxy or butyleneoxy groups, with the provision that the values of a and b in the sidechain are such that the combined weights of R4 and $R_5$ are such that the monomer has a solubility of at least about 500 grams/liter in water Formula II

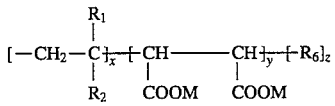

Where $R_6$=

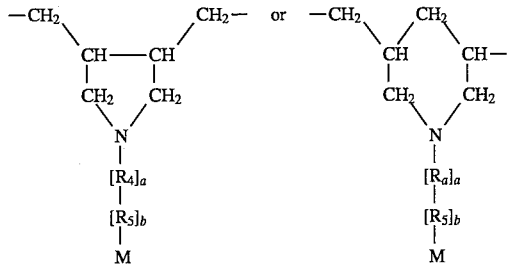

or mixtures of both. In Formula II, x, y, z, a, and b are integers and M is a alkali metal such as sodium, or hydrogen, and the monomer units are in random order. (x+y):z is from about 5:1 to 1000:1, and y can be any value ranging from zero up to the maximum value of x, and $R_1$=H or $CH_3$ $R_2$=COOM, $OCH_3$, $SO_3M$, O—CO—$CH_3$, CO—$NH_2$ $R_4$ is ethyleneoxy and $R_5$ is alkyleneoxy, preferably propyleneoxy or butyleneoxy, with the provision that the values of a and b in the sidechain are such that the combined weights of $R_4$ and $R_5$ are such that the monomer has a solubility of at least about 500 grams/liter in water. The remainder of the detergent formulation is water. The liquid detergent composition has a phase separation of less than about 2% over a one month period.

Also provided as part of the invention is a method of stabilizing a liquid detergent composition which comprises adding thereto about 0.01–5% of at least one hydrophilic copolymer having the above formula.

DETAILED DESCRIPTION OF THE PREFERRED EMBODIMENT

The hydrophilic copolymer of the invention is represented by Formula I or II:

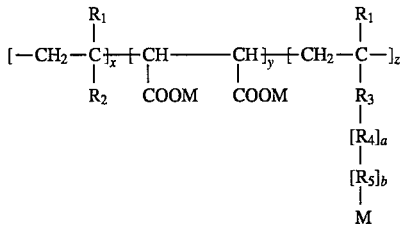

Formula I

Where x, y, z, a, and b are integers and M is a alkali metal, or hydrogen and the monomer units are in random order. (x+y):z is from about 5:1 to 1000:1, and y can be any value ranging from zero up to the maximum value of x.

$R_1$=H or $CH_3$ $R_2$=COOM, $OCH_3$, $SO_3M$, O—CO—$CH_3$, CO—$NH_2$ $R_3$=$CH_2$—O—, $CH_2$—N—, COO—, —O—,

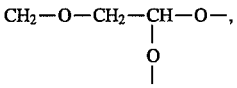

CO—NH—

$R_4$=—$CH_2$—$CH_2$—O $R_5$=alkyleneoxy group, preferably propyleneoxy or butyleneoxy groups, with the provision that the values of a and b in the sidechain are such that the combined weights of $R_4$ and $R_5$ are such that the monomer has a solubility of at least about 500 grams/liter in water

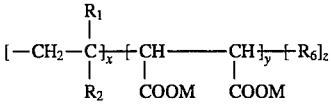

Formula II

Where $R_6$=

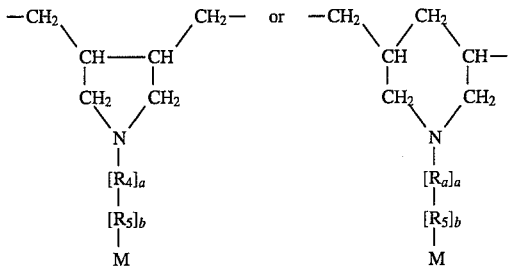

or mixtures of both. In Formula II, x, y, z, a, and b are integers and M is a alkali metal, or hydrogen and the monomer units are in random order. (x+y):z is from about 5:1 to 1000:1, and y can be any value ranging from zero up to the maximum value of x.

$R_1$=H or $CH_3$ $R_2$=COOM, $OCH_3$, $SO_3M$, O—CO—$CH_3$, CO—$NH_2$ $R_4$ is ethyleneoxy and $R_5$ is alkyleneoxy, preferably propyleneoxy or butyleneoxy, with the provision that the values of a and b in the sidechain are such the combined weights of $R_4$ and $R_5$ are such that the monomer has a solubility of at least about 500 grams/liter in water. It is within the scope of the invention that $R_4$ and $R_5$ be interchangeable in the sidechain.

As heretofore stated, the molar ratio of x+y to z in both Formulas I and II is within the range of about 5:1 to 1000:1, preferably about 50:1 to 800:1, and more preferably about 100:1 to 500:1.

The total molecular weight of the copolymer will be within the range of about 500 to 500,000, as determined by gel permeation chromatography. It is further desirable that the molecular weight fall within the range of about 1,000 to 100,000, and even more preferably be within the range of about 1,000 to 10,000 (weight average molecular weight—WAMW; unless otherwise specified, molecular weights herein are given in terms of WAMW).

The hydrophilic copolymer of the present invention is prepared by copolymerizing two hydrophilic monomers, an unsaturated hydrophilic monomer copolymerized with an oxyalkylated monomer. These monomers may be randomly distributed within the polymer backbone. Preparation of oxyalkylated monomers could be prepared in accordance with Tang, U.S. Pat. No. 5,162,475, incorporated herein by reference. In Tang, Example 1 is especially relevant. Gosselink, U.S. Pat. No. 4,622,378, is also relevant, and is also incorporated herein.

The unsaturated hydrophilic monomer may be selected from the group consisting of acrylic acid, maleic acid, maleic anhydride, methacrylic acid, methacrylate esters and substituted methacrylate esters, vinyl acetate, as well as vinyl acetate copolymerized with said oxyalkylated monomer and hydrolyzed to polyvinyl alcohol, methylvinyl ether, and vinylsulphonate. Preferably, the unsaturated hydrophilic monomer component of the hydrophilic copolymer in formula I or II is acrylic acid. Other useful monomers will include crotonic acid, itaconic acid, as well as vinyl acetic acid.

Examples of the oxyalkylated monomer would be compounds that have a polymerizable olefinic moiety with at least one acidic hydrogen and are capable of undergoing addition reaction with alkylene oxide. It is also possible to include monomers with at least one acidic hydrogen that are polymerized first, and then subsequently oxyalkylated to yield the desired product. For example, allyl alcohol is especially preferred since it represents a monofunctional initiator with a polymerizable olefinic moiety having an acidic hydrogen on the oxygen, and is capable of adding to alkylene oxide. Similarly diallylamine represents another monofunctional initiator with polymerizable olefinic moieties, having an acidic hydrogen on the nitrogen, and is capable of adding to alkylene oxide. Other examples of the oxyalkylated monomer of the copolymer will include reaction products of either acrylic acid, methacrylic acid, maleic acid, or 3-allyloxy-1,2-propanediol with alkylene oxide.

Especially preferred is the oxyalkylated monomer which is a propylene oxide and ethylene oxide adduct of allyl alcohol. This monomer has a molecular weight of about 3800, and $R_4$ is a propyleneoxy group represented by the formula $—CH_2—CH(CH_3)—O$ and $R_5$ is $—CH_2—CH_2—O$. In this monomer, $R_1$=H, $R_2$=COOM, $R_3$=$CH_2$—O, and y=0. M is sodium in this monomer as well.

The weight ratio of $R_4$:$R_5$ in the oxyalkylated monomer is preferably about 1:4 (this ratio may vary considerably, so long as the solubility criteria of at least about 500 grams/liter is met).

The molecular weight of the oxyalkylated monomer according to the various embodiments of the invention will be within the range of about 200 to 30,000, more preferably about 500 to 15,000, and more preferably about 1000 to 5000.

The oxyalkylated moiety represents the side chain of this monomer. The side chain is hydrophilic in nature, that is, the side chain when isolated from its linkage to the backbone carbon atom has extensive solubility in water. The monomer unit containing the hydrophilic side chain also has similar solubility characteristics as the side chain. Preferably, the side chain when isolated from its linkage to the backbone will have a solubility in water of at least about 500 grams/liter, and even more preferably about 700 grams/liter, or more. Moreover, the entire side chain is hydrophilic in nature by virtue of its extensive solubility in water.

The hydrophilic copolymer as part of the invention may be prepared by the skilled artisan according to the process below, in which the alkylene oxide adduct of allyl alcohol is copolymerized with acrylic acid by way of a non-limiting example.

Preparation of Alkylene Oxide Adduct of Allyl Alcohol (I)

To a 2 gallon stainless steel autoclave equipped with steam heat, vacuum and nitrogen pressure capability and agitation, a homogenous mixture of 396.2 grams of allyl alcohol and 44.1 grams of potassium t-butoxide was charged. The vessel was sealed, purged with nitrogen and pressurized to 90 psig with nitrogen. The pressure was then relieved to 2 psig and the temperature of the vessel was adjusted to 80° C. The first 125 grams of propylene oxide was added over a 1 hour period. The temperature was maintained between 75°–85° C. and the pressure was maintained at <90 psig. The next 200 grams of propylene oxide was added over a 1 hour period and at 75°–85° C. and <90 psig pressure. The next 400 grams of propylene oxide was added over a 1 hour period at 100°–110° C. and <90 psig pressure. The remaining 4551.2 grams of propylene oxide was charged at 500 grams per hour and at 120°–130° C. and <90 psig pressure. After all of the propylene oxide was added, the mixture was reacted at 125° C. for 2 hours and the vessel was vented to 0 psig. The material was stripped at <10 mm Hg and 125° C. for 1 hour then cooled to 50° C. and discharged into an intermediate holding tank for analysis.

To a 5 gallon stainless autoclave equipped with steam heat, vacuum and nitrogen pressure capability and agitation, 2696.8 grams of the allyl alcohol propylene oxide intermediate was charged. The vessel was sealed and pressurized to 90 psig with nitrogen and vented to 2 psig. This was repeated two more times. The temperature was adjusted to 145° C. and the pressure was readjusted to 34 psig with nitrogen. To the vessel, 10788.9 grams of ethylene oxide was charged at 1400 grams per hour. The temperature was maintained at 140°–150° C. and the pressure was maintained at <90 psig. If the pressure rose above 85 psig, the ethylene oxide addition was slowed. If this failed to lower the pressure, the addition was halted and allowed to react at 145° C. for 30 minutes. The vessel was slowly vented to 0 psig and repadded to 34 psig with nitrogen. The addition was continued at 140°–150° C. and <90 psig pressure.

After all of the ethylene oxide was added, the material was held at 145° C. for 1 hour. It was then cooled to 90° C. and 14.3 grams of 85% phosphoric acid was added. The material was mixed for 30 minutes and then vacuum stripped at 100° C. for 1 hour. The batch was cooled to 70° C. and discharged into a holding tank. The product was found to have a number average molecular weight of 4091 by phthalic anhydride esterification in pyridine.

Polymerization of I with Acrylic Acid

To a two liter, four necked flask equipped with a mechanical stirrer, reflux condenser, thermometer, and outlet for feed lines, were added 301 grams of distilled water and 2.6 grams of 70% phosphorous acid. This solution was heated to 95 degrees centigrade at which time a monomer blend of 555.4 grams of glacial acrylic acid and 61.7 grams of an allyl alcohol initiated propoxylate ethoxylate (I)(molecular weight @ 3500), a redox initiator system consisting of 132 grams of a 38% sodium bisulfite solution and 155.4 grams of a 10.9 % sodium persulfate solution, are fed into the flask linearly and separately while maintaining the temperature at 95 + or − 3 degrees centigrade. The sodium bisulfite solution and monomer blend feeds are added over 4 hours while the sodium persulfate solution is added over 4.25 hours. The three feeds are added via teflon ⅛ inch tubing lines connected to rotating piston pumps. Appropriately sized glass reservoirs attached to the pumps hold the monomer blend and initiator feeds on balances accurate to 0.1 gram to precisely maintain feed rates. When the additions are complete, the system is cooled to 80 degrees centigrade. At 80 degrees centigrade, 25.3 grams of a 2.4% 2,2'-Azobis (N,N'-dimethyleneisobutyramidine) dihydrochloride solution is added to the system over 0.5 hours as a postpolymerizer. When addition is complete the system is reacted for 2 hours at 80 degrees centigrade. After reaction, the system is cooled to 60 degrees centigrade and the solution pH is adjusted to about 7 with the addition of 658 grams of 50% sodium hydroxide solution. The resultant neutral polymer solution has an approximate solids content of 40%.

The presence of the hydrophilic copolymer of the invention is added to detergent compositions, hereinafter described, to impart stability thereto. For purposes of definition, stable detergent compositions are those that do not give more than about a 2% phase separation upon storage at room temperature for a period of one month (30 days) from the time of preparation. Preferably, the phase separation is within the range of about 0–2%, and even more preferably less than about 1%. The volume fraction of the separated aqueous phase is measured as a function of the total volume of the sample. For example, if the total volume of the sample is 100 mL, then a 2% separation would correspond to 2 mL.

The hydrophilic copolymer will therefore comprise about 0.01 to 5% by weight of the liquid detergent composition. Preferably, the copolymer of the invention will make up about 0.5 to 4% of a typical laundry formulation, even more preferably about 1 to 2%. (Unless otherwise stated, all weight percentages are based upon the weight of the total laundry formulation).

The laundry formulation will contain about 5 to 70% of detergent active matter, more preferably about 15 to 40%, and even more desirably greater than about 25 and up to about 35%.

The detergent active matter may be selected from the group of anionic, nonionic, cationic, amphoteric and zwitterionic surfactants known to the skilled artisan. Examples of these surfactants may be found in McCutcheon, *Detergents and Emulsifiers* 1993, incorporated herein by reference. Examples of nonionic surfactants will include commonly utilized nonionic surfactants which are either linear or branched and have an HLB of from about 6 to 18, preferably from about 10 to 14. Examples of such nonionic detergents are alkylphenol oxyalkylates (preferably oxyethylates) and alcohol oxyethylates. Examples of the alkylphenol oxyalkylates include $C_6$-$C_{18}$ alkylphenols with about 1–15 moles of ethylene oxide or propylene oxide or mixtures of both. Examples of alcohol oxyalkylates include $C_6$-$C_{18}$ alcohols with about 1–15 moles of ethylene oxide or propylene oxide or mixtures of both. Some of these types of nonionic surfactants are available from BASF Corp. under the trademark PLURAFAC. Other types of nonionic surfactants are available from Shell under the trademark NEODOL. In particular, a $C_{12}$-$C_{15}$ alcohol with an average of 7 moles of ethylene oxide under the trademark NEODOL® 25-7 is especially useful in preparing the laundry detergent compositions useful in the invention. Other examples of nonionic surfactants include products made by condensation of ethylene oxide and propylene oxide with ethylene diamine (BASF, TETRONIC® and TETRONIC® R). Also included are condensation products of ethylene oxide and propylene oxide with ethylene glycol and propylene glycol (BASF, PLURONIC ® and PLURONIC® R). Other nonionic surface active agents also include alkylpolyglycosides, long chain aliphatic tertiary amine oxides and phosphine oxides.

Typical anionic surfactants used in the detergency art include the synthetically derived water-soluble alkali metal salts of organic sulphates and sulphonates having about 6 to 22 carbon atoms. The commonly used anionic surfactants are sodium alkylbenzene sulphonates, sodium alkylsulphates and sodium alkylether sulphates. Other examples include reaction products of fatty acids with isethionic acid and neutralized with sodium hydroxide, sulphate esters of higher alcohols derived from tallow or coconut oil, and alpha-methylestersulfonates.

Examples of amphoylitic detergents include straight or branched aliphatic derivatives of heterocyclic secondary or tertiary amines. The aliphatic portion of the molecule typically contains about 8 to 20 carbon atoms. Zwitterionic detergents include derivatives of straight or branched aliphatic quaternary ammonium, phosphonium or sulfonium compounds.

The laundry detergent formulation will also contain one or more electrolytes. Electrolytes defined herein are any ionic water-soluble material. The presence of the electrolyte is often required to bring about the structuring of the detergent active material, although lamellar dispersions are reported to be formed with detergent active material alone in the absence of a suitable electrolyte. Electrolytes typically comprise from about 1 to 60% by weight, and more preferably about 25 to 35% of a laundry detergent formulation.

Examples of suitable electrolytes include compounds capable of providing sufficient ionic strength to the aqueous detergent composition. These compounds would include alkali metal salts of citric acid, alkali metal carbonates, and alkali metal hydroxides. Of these, sodium citrate, sodium carbonate and sodium hydroxide are preferred. Potassium salts can also be incorporated to promote better solubility. Other examples of suitable electrolytes will include the phosphate salts such as sodium or potassium tripolyphosphate, and alkali metal silicates.

In many cases the electrolyte utilized will also serve as the builder for enhancing detergency. The builder material sequesters the free calcium or magnesium ions in water and promote better detergency. Additional benefits provided by the builder are increased alkalinity and soil suspending properties. With the near phase-out of phosphate in household laundry detergents, the most commonly used nonphosphate builders are the alkali metal citrates, carbonates, bicarbonates and silicates. All of these compounds are water-soluble. Water-insoluble builders which remove hardness ions from water by an ion-exchange mechanism are the crystalline or amorphous aluminositicates referred to as zeolites. Mixtures of electrolytes or builders can also be employed. Generally, the amount of electrolyte used in laundry detergent compositions according to the invention will be well above the solubility limit of the electrolyte. Thus, it is possible to have undissolved electrolyte which remains suspended in the liquid matrix. Secondary builders such as the alkali metals of ethylene diamine tetraacetic acid, nitrilotriacetic acid can also be utilized in the laundry formulations or the invention. Other secondary builders known to those skilled in the art may also be utilized.

The laundry detergent formulations heretofore described may also contain additional ingredients such as enzymes, anti-redeposition agents, optical brighteners, as well as dyes and perfumes known to those skilled in the art. Other optional ingredients may include fabric softeners, foam suppressants, and oxygen or chlorine releasing bleaching agents.

EXAMPLES

The following examples will serve to demonstrate the efficacy of the hydrophilic copolymer according to various embodiments of the invention. These examples should not be construed as limiting the scope of the invention.

The examples describe the various aqueous liquid detergent compositions of this invention which are stable. The numbers in each column refer to the active weight percentage of each component in the detergent formulation.

The nonionic surfactant used in the formulations shown in the Tables is NEODOL® 25-7, a product of Shell. The linear alkylobenzene sulfonic acid, sodium salt (LAS) was obtained from Vista under the name Vista C-560 slurry. The zeolite was "ZEOLITE A", also known as VALFOR® 100, available from the PQ corp of Valley Forge, Pa. Unless otherwise indicated, the polymer used in the formulations was a copolymer of acrylic acid with an oxyalkylated allyl alcohol, within the scope or the invention. The ratio of acrylic acid to oxyalkylated allyl alcohol was 90:10 by weight, while the molar ratio was about 474:1. The oxyalkylated monomer component had a molecular weight of about 3800, and $R_4$ was a propyleneoxy group represented by the formula —$CH_2$—$CH(CH_3)$—O and $R_5$ was —$CH_2$—$CH_2$—O. in this monomer, $R_1$=H, $R_2$=COOM, $R_3$=$CH_2$—O, and y=0. Also in this monomer, M=sodium.

Tables 1, 2 and 4 demonstrate the flexibility of formulating concentrated aqueous liquid detergents that allow the incorporation of major amounts of builders such as sodium citrate, sodium carbonate, and zeolite in the formulation. Furthermore, these compositions were pourable, stable compositions.

Polycarboxylates are difficult to incorporate in concentrated liquid detergents because of their incompatibility with surfactants. Example 9 in Table 3 shows that water-soluble polycarboxylates can be successfully incorporated in concentrated liquid detergent formulations that contain relatively small amounts of a copolymer according to one or more embodiments of the invention. Table 3 also illustrates several examples of detergent formulations that lack stability despite the inclusion of hydrophobically modified polymers.

TABLE 1

| Component | EX.1 | EX.2 | EX.3 |
|---|---|---|---|
| LAS | 28.2 | 30 | 28.2 |
| Nonionic Surfactant | 6.6 | 7 | 6.6 |
| Sodium Citrate | 13.5 | 22 | 13.5 |
| Polymer | 1 | 1 | 0 |
| Water | 50.7 | 40 | 51.7 |
| Comment | Stable | Stable | Unstable |

TABLE 2

| Component | EX.4 | EX.5 | EX.6 | EX.7 | EX.8 |
|---|---|---|---|---|---|
| LAS | 25 | 25 | 25 | 15 | 5 |
| Nonionic Surfactant | 7 | 7 | 7 | 5 | 15 |
| Sodium Citrate | 6 | 5 | 5 | | |
| Sodium Carbonate | 15 | 8 | 8 | 8 | 8 |
| Zeolite | | 10 | 10 | 22 | 22 |
| Lipolase | | 0.5 | | | |
| Savinase | | 0.5 | | | |
| Termamyl | | 0.5 | | | |
| Calcium Chloride | | 50 ppm | | | |
| polymer | 1 | 1 | 1 | 1 | 1 |
| Water | 45 | 42.5 | 45 | 49 | 49 |
| Comment | Stable | Stable | Stable | Stable | |

TABLE 3

| Component | EX. 9 | EX. 10 | EX.11 | EX.12 | EX.13 |
|---|---|---|---|---|---|
| LAS | 25 | 28.3 | 30.5 | 17.43 | 28.2 |
| Nonionic Surf. | 7 | 6.6 | 7.1 | 7 | 6.6 |
| Sodium Citrate | 5 | 13.5 | 8 | 9.33 | 13.5 |
| Sodium Carbonate | 8 | | | | |
| Zeoiite | 10 | | | | |
| Sokalan ® CP.5 | 1.3 | | | | |
| Sokalan ® PA30C1 | 1.3 | | | | |
| Sokalan ® | HP22 | 1.3 | | | |
| Polymer | 1 | *1 | **0.45 | #0.88 | ##1 |
| Water | 40 | 50.7 | 53.93 | 65.39 | 50.7 |
| Comment | Stable | Unstable | Unstable | Unstable | Unstab |

*Hydrophobically modified polyether - PLURAFLO ® AT 301 (BASF)
**Modified polycarboxylate - SOKALAN ® HP 25 (BASF)
#Maleic acid/olefin copolymer - SOKALAN ® CP 9 (BASF)
Polycarboxylate, sodium salt - SOKALAN ® PA 30 CL (BASF)
SOKALAN ® CPS - Acrylic acid/Maleic Acid copolymer - product of BASF.
SOKALAN ® PA30C1 - Polyacrlylic acid, sodium salt - product of BASF
SOKALAN ® HP 22 - a nonionic graft copolymer - product o;f BASF

TABLE 4

| Component | EX.14 | EX. 15 | EX.16 | EX.17 |
|---|---|---|---|---|
| LAS | 25 | 8 | 8 | 30 |
| Nononic Surfactant | 7 | 2 | 2 | 0 |
| Sodium Carbonate | 15 | 15 | 25 | 15 |
| Polymer | 1 | 1 | 1 | 1 |
| Water | 52 | 74 | 64 | 54 |
| Comment | Stable | Stable | Stable | Stable |

Lipolase, Savinase and Termamyl are laundry enzymes—Novo Nodisk BioIndustrials, Inc., Danbury, Conn.

While the invention has been described in each of its various embodiments, it is to be expected that certain modifications thereto may occur to those skilled in the art without departing from the true spirit and scope of the invention as set forth in the specification and the accompanying claims.

What is claimed is:

1. A stable, aqueous concentrated liquid detergent composition, comprising by weight:

a) about 25–70% of detergent active matter selected from the group consisting of anionic, nonionic, cationic, amphoteric and zwitterionic surfactants;

b) about 1–60% of one or more electrolytes;

c) about 0.01–4% of at least one hydrophilic copolymer, comprised of an unsaturated hydrophilic monomer copolymerized with a hydrophilic oxyalkylated monomer, selected from Formula I, Formula II, or both, wherein Formula I is:

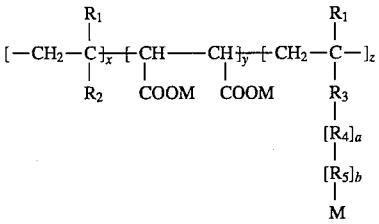

wherein x and y are integers representing the amounts of the said unsaturated hydrophilic monomer in Formula I; and wherein z is an integer representing the amount of the said hydrophilic oxyalkylated monomer in Formula I; a and b are integers representing the amounts of $R_4$ and $R_5$ in the said hydrophilic oxyalkylated monomer; wherein further, $R_4$ and $R_5$ are interchangeable and M is an alkali metal or hydrogen, and said monomer units are in random order; (x+y):z is from about 5:1 to 1000:1, y is zero up to the value of x; wherein further each $R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

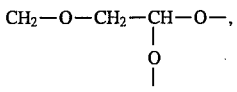

CO—NH;—

$R_4$=ethyleneoxy and $R_5$=propyleneoxy or butyleneoxy, wherein the values of a and b are such that the combined weights of $R_4$ and $R_5$ are such, wherein said hydrophilic oxyalkylated monomer has a solubility of at least about 500 grams/liter in water;

and Formula II is:

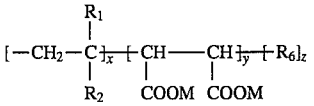

Where $R_6$=

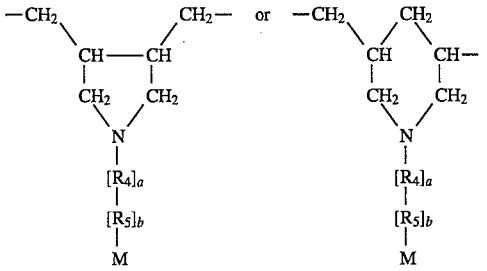

or mixtures of both, wherein in Formula II, wherein x and y are integers representing the amounts of the said unsaturated hydrophilic monomer in Formula II; and wherein z is an integer representing the amount of the said hydrophilic oxyalkylated monomer in Formula II; a and b are integers representing the amounts of $R_4$ and $R_5$ in the said hydrophilic oxyalkylated monomer; wherein further $R_4$ and $R_5$ are interchangeable and M is an alkali metal or hydrogen, and said monomer units are in random order; (x+y): z is from about 5:1 to 1000:1, y is zero up to the value of x; each $R_1$=H or $CH_3$;

$R_2$=COOM, $OCH_3$, $SO_3M$, O—CO—$CH_3$, CO—$NH_2$;

$R_4$ is ethyleneoxy and $R_5$ is propyleneoxy or butyleneoxy, wherein the values of a and b are such that the combined weights of $R_4$ and $R_5$ are such wherein said hydrophilic oxyalkylated monomer has a solubility of at least about 500 grams/liter in water; and the balance, water; e)

d) said composition having a phase separation of less than about 2% over a one month period.

2. The composition as claimed in claim 1, wherein said unsaturated hydrophilic monomer in Formula I or II is selected from the group consisting of acrylic acid, maleic acid, maleic anhydride, methacrylic acid, methacrylate esters and substituted methacrylate esters, vinyl acetate, vinyl acetate copolymerized with said hydrophilic oxyalkylated monomer and hydrolyzed to polyvinyl alcohol, methylvinyl ether, and vinylsulphonate.

3. The composition as claimed in claim 2, wherein said oxyalkylated monomer in formula I or II is selected from the group consisting of compounds having a polymerizable olefinic moiety with at least one acidic hydrogen and are capable of undergoing addition reaction with alkylene oxide, and compounds which include monomers having at least one acidic hydrogen that are polymerized first, and then subsequently oxyalkylated.

4. The composition as claimed in claim 3, wherein said oxyalkylated monomer is the propylene oxide/ethylene oxide adduct allyl alcohol.

5. The composition as claimed in claim 3, wherein said oxyalkylated monomer is the propylene oxide/ethylene oxide adduct of diallylamine.

6. The composition as claimed in claim 4, wherein the weight average molecular weight of said hydrophilic copolymer of formula I or II is in the range of about 500 to 500,000.

7. The composition as claimed in claim 5, wherein said unsaturated hydrophilic monomer in formula I or II is acrylic acid.

8. The composition as claimed in claim 6, wherein the molar ratio of said unsaturated hydrophilic monomer to said oxyalkylated monomer in formula I or II is within the range of about 5:1 to 1000:1.

9. The composition as claimed in claim 7, wherein the weight average molecular weight of said oxyalkylated monomer in formula I or II is within the range of about 200 to 30,000.

10. A method of stabilizing an aqueous concentrated liquid detergent composition, comprising adding to said liquid detergent composition about 0.01–4% of at least one hydrophilic copolymer, comprised of an unsaturated hydrophilic monomer copolymerized with a hydrophilic oxyalkylated monomer, selected from Formula I, Formula II, or both, wherein Formula I is:

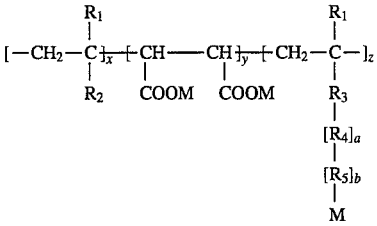

wherein x and y are integers representing the amounts of the said unsaturated hydrophilic monomer in Formula I; and wherein z is an integer representing the amount of the said hydrophilic oxyalkylated monomer in Formula I; a and b are integers representing the amounts of $R_4$ and $R_5$ in the said hydrophilic oxyalkylated monomer; wherein further $R_4$ and $R_5$ are interchangeable and M is an alkali metal or hydrogen, and said monomer units are in random order; (x+y):z is from about 5:1 to 1000:1, y is zero up to the value of x; wherein further each $R_1$=H or $CH_3$;

$R_2$=COOM, $OCH_3$, $SO_3M$, O—CO—$CH_3$, CO—$NH_2$;

$R_3$=$CH_2$—O—, $CH_2$—N—, COO—, —O—,

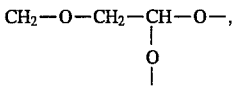

CO—NH;—

$R_4$=ethyleneoxy and $R_5$=propyleneoxy or butyleneoxy, wherein the values of a and b are such that the combined weights of $R_4$ and $R_5$ are such, wherein said hydrophilic oxyalkylated monomer has a solubility of at least about 500 grams/liter in water;

and Formula II is:

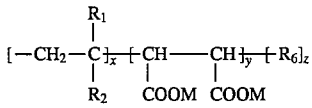

Where $R_6$=

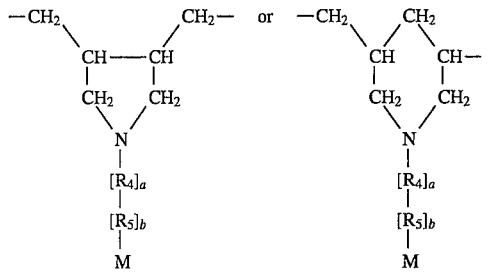

or mixtures of both, wherein in Formula II, wherein x and y are integers representing the amounts of the said unsaturated hydrophilic monomer in Formula II; and wherein z is an integer representing the amount of the said hydrophilic oxyalkylated monomer in Formula II; a and b are integers representing the amounts of $R_4$ and $R_5$ in the said hydrophilic oxyalkylated monomer; wherein further $R_4$ and $R_5$ are interchangeable and M is an alkali metal or hydrogen, and said monomer units are in random order; (x+y):z is from about 5:1 to 1000:1, y is zero up to the value of x; each $R_1$=H or $CH_3$;

$R_2$=COOM, $OCH_3$, $SO_3M$, O—CO—$CH_3$, CO—$NH_2$;

$R_4$ is ethyleneoxy and $R_5$ is propyleneoxy or butyleneoxy, wherein the values of a and b are such that the combined weights of $R_4$ and $R_5$ are such wherein said hydrophilic oxyalkylated monomer has a solubility of at least about 500 grams/liter in water;

wherein said liquid detergent composition further comprises about 25–70 wt. % detergent active matter selected from the group consisting of anionic, nonionic, cationic, amphoteric and zwitterionic surfactants, about 1–60 wt. % electrolyte, and the balance, water; and wherein the resultant stabilized liquid detergent composition has a phase separation of less than about 2% over a one month period.

11. The method as claimed in claim 10, wherein said unsaturated hydrophilic monomer in Formula I or II is selected from the group consisting of acrylic acid, maleic acid, maleic anhydride, methacrylic acid, methacrylate esters and substituted methacrylate esters, vinyl acetate, vinyl acetate copolymerized with said hydrophilic oxyalkylated monomer and hydrolyzed to polyvinyl alcohol, methylvinyl ether, and vinylsulphonate.

12. The method as claimed in claim 11, wherein said oxyalkylated monomer in formula I or II is selected from the group consisting of compounds having a polymerizable olefinic moiety with at least one acidic hydrogen and are capable of undergoing addition reaction with alkylene oxides, and compounds which include monomers having at least one acidic hydrogen that are polymerized first, and then subsequently oxyalkylated.

13. The method as claimed in claim 12, wherein said oxyalkylated monomer is the propylene oxide/ethylene oxide adduct of allyl alcohol.

14. The method as claimed in claim 12, wherein said oxyalkylated monomer is the propylene oxide/ethylene oxide adduct of diallylamine.

15. The method as claimed in claim 13, wherein the weight average molecular weight of said hydrophilic copolymer of formula I or II is in the range of about 500 to 500,000.

* * * * *